United States Patent [19]

Roberts

[11] 4,297,683

[45] Oct. 27, 1981

[54] VANDAL ALARM SYSTEM FOR PARKING METERS

[76] Inventor: Ralph R. Roberts, 740 Hillsdale Ave., Hillsdale, N.J. 07642

[21] Appl. No.: 127,589

[22] Filed: Mar. 6, 1980

Related U.S. Application Data

[63] Continuation-in-part of Ser. No. 23,014, Mar. 22, 1979, abandoned.

[51] Int. Cl.[3] ..... G08B 19/00; G08B 25/00

[52] U.S. Cl. ..... 340/539; 200/61.52; 340/540; 340/568; 340/689

[58] Field of Search ..... 340/539, 689, 668, 550, 340/540, 568; 200/61.52, 61.18, DIG. 8

[56] References Cited

U.S. PATENT DOCUMENTS

| | | | |
|---|---|---|---|
| 1,995,082 | 3/1935 | Stotts | 340/550 |
| 2,937,269 | 5/1960 | Miller | 340/539 |
| 3,208,061 | 9/1965 | Gervasi et al. | 340/539 |
| 3,422,398 | 1/1969 | Rubin | 340/550 |
| 3,831,163 | 8/1974 | Byers | 340/539 |
| 3,971,006 | 7/1976 | Pressly, Jr. | 200/61.52 |
| 4,110,738 | 8/1978 | Sattin | 340/539 |

*Primary Examiner*—Glen R. Swann, III
*Attorney, Agent, or Firm*—Ralph R. Roberts

[57] ABSTRACT

Vandalism and robbery of parking meters have become big problems. The unauthorized entry into the coin box area or striking of the housing as well as bending the support pipe makes it desirable to apprehend the robbers and/or vandals. Repair of the parking meter or support may be required due to such vandalism. A radio transmitter is adapted to send simultaneously two signals to a receiver which is constantly "on". The received signal indicates unauthorized entry or vandalism to a parking meter and to the particular parking meter from which the signal is sent. Switches are actuated at an opening of the timer compartment and/or coin box area. A switch is also actuated when the supporting post is bent. A timer is placed in this circuit so that only after a determined time interval is a signal sent of the bending of a post. On new installations a tensioned wire is placed in the pipe and is actuated when the pipe is cut or severely bent.

8 Claims, 6 Drawing Figures

VANDAL ALARM SYSTEM FOR PARKING METERS

CROSS-REFERENCE TO RELATED APPLICATION

This is a Continuation-In-Part Application of my application Ser. No. 023,014 filed Mar. 22, 1979, now abandoned, and having the same title.

BACKGROUND OF THE INVENTION

DESCRIPTION OF THE PRIOR ART

Protection of municipality owned parking meters has become a big problem. This protection need extends to vandalism which includes the willful destruction of the parking meter and/or the timing mechanism therein. Protection against the entry into the coin box of the parking meter by unauthorized persons to remove the coins therein is also needed. A protective alarm system using a radio transmitter and receiver is described in U.S. Pat. No. 3,208,061 to GERVASI et al. as issued on Sept. 21, 1965. In this and other protective alarm systems the particular problem of the exposure of the parking meter to vandalism and appropriate police protection and apprehension has not been achieved.

Attempts to protect parking meters against vandalism and unlawful entry include making the housings of the parking meters of a much heavier construction such as nodular iron. This still does not prevent the cutting of the post and removal of the complete meter. Access to the coin box by use of a key illegally obtained or copied is also a problem. Alarm systems using wire conductors such as in fire and police system call boxes in large municipalities have been suggested but the cost of having the wires below the sidewalks or street is too great and the possibility of cutting or shorting the inbedded wires is also large.

Radio transmitters in parking meters has been proposed for at least twenty years and this invention does not suggest or propose that the radio receivers and transmitters are to be reinvented. Short range radio transmitters and receivers have been and are used by the million units in garage door opening devices and in C.B. (Citizens Band) radio transmitters and receivers. It is contemplated that frequencies available to municipalities will be used.

It is also recognized that installation of a large percentage of the detecting devices will be into existing parking meters. In many of these cases the bolt securing the housing to the post is rusted and or otherwise is frozen and removal of the bolt is impossible or impractical. Where and when this is the condition in the existing parking meter, means must be provided for the detecting of vandal removal of the parking meter by cutting the pipe on which it is mounted. Attitude or level switch means is provided for both new and existing meter installations. Prior inventions and patents pertaining to parking meter alarms have shown a radio transmitter enclosed within a parking meter and a radio receiver located some distance therefrom. The present invention uses a radio transmitter and receiver and proposes to cover the various aspects of vandalism to a parking meter which includes unauthorized opening of both the cover and the coin access door. In addition there is provided a timing device which insures that the parking meter signal is continued for a certain definite period of time, an indicator device or monitor is adapted to indicate that vandalism in the form of striking or cutting off the parking meter is noted. A level or attitude measuring device is provided with this vandalism alarm device so that a bending of the pipe is detected. After ascertaining that the parking meter is still intact an observer can report to the monitor which then removes the monitor's signal which can then be shut off as far as immediate detection or indication is concerned. The sawing off or severing of the pipe support for the meter is detected by either of the two means fully described hereinafter. The present invention is directed particularly to the detection of vandalism to a parking meter as now occurs in the larger cities where vandalism for profit or malicious mischief is deliberately done to a parking meter. Rapid detection of vandalism is made by the monitor who relays this information usually to radio equipped vehicles generally patrol or police cars.

SUMMARY OF THE INVENTION

This invention may be summarized at least in part, with reference to its objects. It is an object of this invention to provide, and it does provide, a vandalism alarm for new and existing parking meters in which a series of switches are provided. These switches are placed at each access opening and said switches are adapted to be closed when a cover or door is opened. A tilting or cutting of the mounting post also is detected and a switch closed. The closing of any switch actuates a radio transmitter which sends a code signal to a radio receiver by which the parking meter being vandalized is identified.

It is a further object of this invention to provide, and it does provide, a vandalism alarm for parking meters which employs a radio transmitter with two frequencies of signals. The radio receiver receives these signals and decodes them and sends them as electrical pulses to a signal display whereat an observer at this monitoring station or position can ascertain which parking meter is being vandalized and whether the signal is simply a matter of a bent post or stanchion.

The vandalism alarm system for parking meters to be hereinafter more fully described includes a radio transmitter and receiver and, at the parking meter, switches which are normally closed when a cover and/or door is opened. These switches actuate a radio signal through a timing device which insures that the signal is continued for a selected period of time. In the case of existing parking meters which are not or cannot easily be removed from their support there is a dual purpose level detection switch. A bending of the pipe upon which the parking meter is mounted when the installation is rapped or struck to cause a certain determined degree of bend, for example thirty to forty degrees, actuates a signal of this bend which will not begin until a certain period of time has expired. After this time interval a signal is sent to the monitor preferably on a different radio wave length. On the older installations a second level detecting portion of the tilt switch is actuated when the pipe is bent more than sixty degrees. A radio signal is sent instantaneously to the monitor. This switch for the larger bend or removal of the parking meter actuates the transmitter to thus send a signal to the monitor.

On a new meter installation a cable is run down the pipe and bending of the pipe or a cutting of said cable or pipe actuates a signal to indicate to the monitor that a cutting or bending of this cable has occurred. This cable is spring tensioned to actuate a switch to send a signal to and through the radio transmitter to the monitor.

In addition to the above summary the following disclosure is detailed to insure adequacy and aid in understanding of the invention. This disclosure, however, is not intended to cover each new inventive concept no matter how it may later be disguised by variations in form or additions of further improvements. For this reason there has been chosen a specific embodiment of a vandal alarm system for parking meters as adapted for use on existing and new installations and showing a preferred means for arranging and mounting this system. This specific embodiment has been chosen for the purpose of illustration and description as shown in the accompanying two sheets of drawings wherein:

BRIEF DESCRIPTIONS OF THE DRAWINGS

DESCRIPTION OF THE PREFERRED EMBODIMENT

Figure 1:
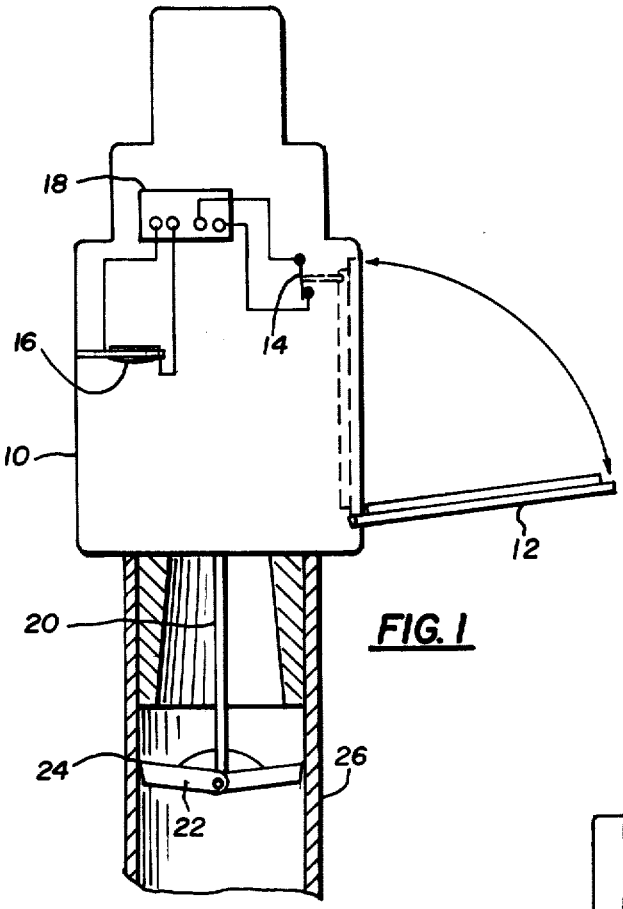
FIG. 1 represents a side view partly schematic, and showing a switch means by which the opening of the coin box door is detected and a signal is sent from the transmitter to the monitor.

Referring now to the two sheets of drawings, there is seen in FIG. 1 a partly diagrammatic view in which an enclosure 10 has a hinged access door 12 normally opened by a key carried by the coin collecting officer or attendant. When door 12 is swung open for removal of the coin box, not shown, switch 14 is closed and a signal is sent to the monitor. Also shown is a tilt switch 16 which, when closed, sends a signal to a transmitter 18. Extending below the housing 10 is shown a cable or cord 20 and a grabber hooks or means 22 which swing to the open position so that when the said cable or cord is lifted upwardly the sharp prongs or sharpened ends 24 engage the wall of the pipe or tube 26. This cable or cord when lifted upwardly and tightened by means of a spring to hereinafter be described causes the cable to be brought into a more-or-less taut condition.

Figure 2:
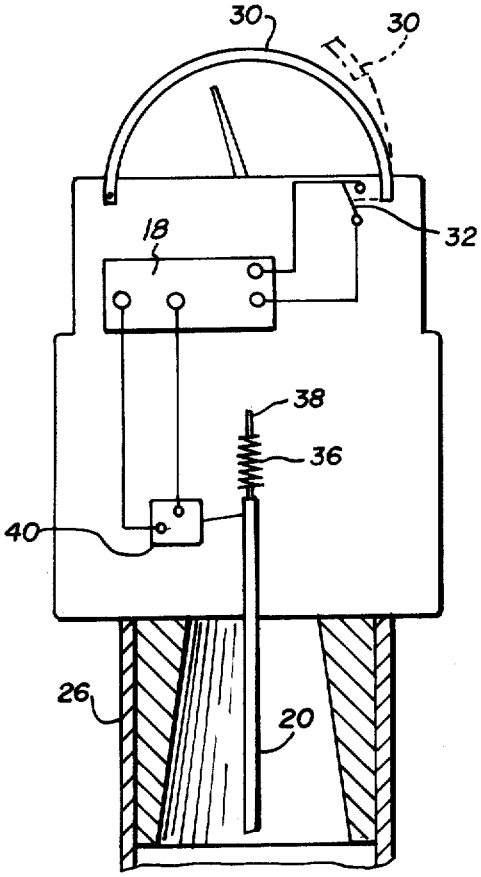
FIG. 2 represents a front view, partly schematic, of the parking meter and showing in particular a switch actuator which is employed with a new parking meter in which a cord or cable may be tensioned in the supporting pipe of a parking meter and also showing a switch detection for the lifting of the top cover in and through which the mechanism of the parking meter is inserted.

Description of the Vandal Alarm as in FIG. 2

Referring now to FIG. 2 it is to be noted that a top cover generally indicated as 30 may be swung upwardly for removal of the timing mechanism normally associated with parking meters. This top cover 30 is swung into position as seen in the solid outline and actuates switch 32 to cause it to be opened. This switch 32, when the cover is lifted as seen in the dashed outline, is closed and actuates the transmitter 18 which sends a signal to the monitor. As noted in the discussion of FIG. 1 the cable or cord cable 20 is tensioned by a spring 36 which is adjusted by a screw 38 which is threaded and adjusted so that the cable or cord 20 is brought into the desired tension. A switch 40 when the cable or cord is brought into the desired tension is in a normally open position to a position but when the pipe or tube is bent to cause the conductor to be stretched or shortened then the switch 40 is actuated. A cutting of pipe and/or conductor 26 causes the switch 40 to be actuated.

Figure 3:
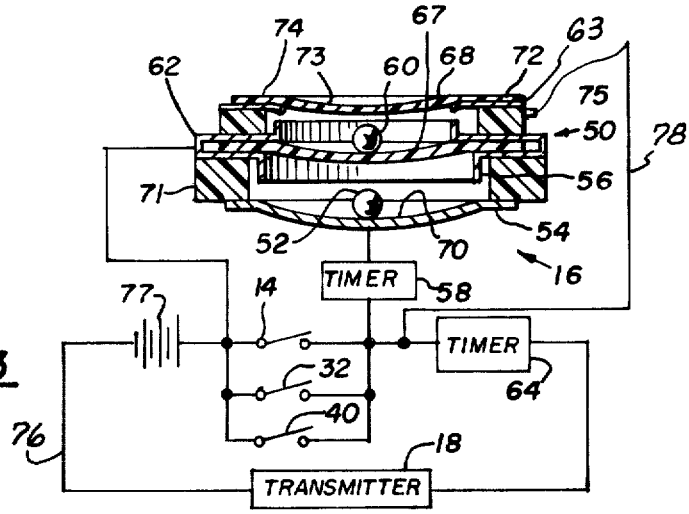
FIG. 3 shows a partly sectional schematic view of a tilt switch and also the circuit diagram in which dual radio signals may be sent from the parking meter.

Tilt Switch as seen in FIG. 3

In FIG. 3 is shown a dual purpose tilt switch 50. In and by a lower portion of this switch 50 is carried a ball 52 which rolls on a conducting plate 54. When the switch is tilted to approximately twenty or more degrees the ball 52 rolls against conducting ring 56 to make a closure of the tilt switch which sends a signal to the transmitter 18. Since a jostling or striking of the parking meter may cause this ball to temporarily move from an "at rest" position to a position against the ring 56, it is desired that a signal not be sent unless a permanent bending of the support occurs. A timer 58, for example, may have a fifteen second or more delay before a signal is sent to the transmitter 18. Where this tilt switch is to be employed, as in older parking meters, a second switch is mounted on top of this tilt switch to indicate forty-five degrees or more tilt.

When a new parking meter has the pipe supporting the parking meter cut, the parking meter is generally pulled or tilted at an angle greater than forty-five degrees. In existing installations this second tilt switch includes a ball 60 which engages the two conductors 62 and 63 to send a signal to the transmitter. Also shown in FIG. 3 is a schematic in which transmitter 18 is shown being actuated by the switch 14, 32, or 40 and at the closing of any switch a timer 64 continues its signal for a determined period of time, say thirty seconds. Timer 58 delays the actuation of the signal from the lower first tilt switch but after this signal has been sent to and through timer 64, this signal is sent by the transmitter 18 to the monitoring station.

The switch 40 indicating the tilt for a bent pipe may also close the switch indicating the tilt when it exceeds more than forty-five degrees. The second tilt switch includes the ball 60 which connects conductors 62 and 63 which indicate a tilt of the ball 60 to greater than forty-five degrees. A shallow depression or cup 67 may be provided and a cover 68 is formed with a convex contour which insures that the tilt switch at the occasion of a degree of tilt greater than forty-five degrees carries the ball 60 to the outer conductors 62 and 63. Conductors 62 and 63 are spaced apart or are insulated so that only when and where the ball 60 advances to the outer extent does the ball close the circuit and send a signal. A signal that a pipe is being cut or that the degree of tilt is excessive, therefore, sends a signal to the transmitter 18 without a delay timer 58.

In the switch as shown in FIG. 3 it is to be noted that the lower ball 52 is carried in shallow dish 70 and a plastic ring 71. With a second tilt switch a top cover of plastic 72 has a small cup portion 73. Top cover 72 may be attached by screws or adhesive and in addition to a protective ring or sheath 75 includes means for feeding the conductors 62 and 63 to the input side of timer 64.

The lower switch utilizing a tilt of about thirty degrees is actuated when ball 52 moves from the shallow recess to bring ball 52 into engagement with ring 56 and plate 54. A path leads through conductor 76 from battery 77 to transmitter 18. Timer 58 employs a delay of given duration. The auxiliary switch reading forty-five plus degrees is actuated when ball 60 engages conducting rings 62 and 63. The top cover 72 insures that the ball 60, when tilted to an acute angle, does not move away from the conductors 62 and 63. Contact of and from ring 62 is common with ring 56. Ring 63 is connected by conductor 78 to the circuit before timer 64.

Figure 4:
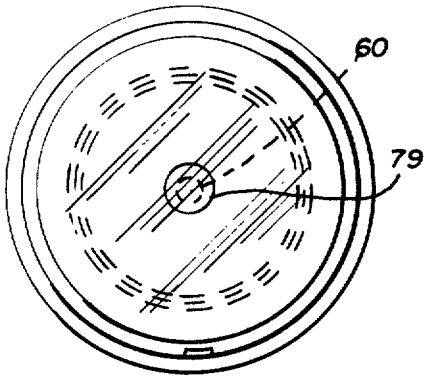
FIG. 4 represents a plane view, partly diagrammatic, and showing an indicator means for installing the tilt switch in a desired attitude.

Tilt Switch Indicator of FIG. 4

In older installations where switch 40 cannot be used it is desirable than an upper tilt switch 60 be utilized to send a signal to the transmitter and from thence through the timer to the monitor who can ascertain that the parking meter is being vandalized by removal or is bent to an extent greater than the thirty or forty degrees normally accepted for a short period of time. In FIG. 4, it is to be noted that the ball 60 used in the upper tilt switch may also be utilized for a level indicator. Balls 52 and 60 are normally carried in a very shallow depression with a locating indicator ring within which the ball is to be retained. These rings are in a substantially level condition. The tilt switch, using a ball indicator in a shallow depression, also provides an all angle level indicator. It may be desirable to also provide signal means in addition to the ball to indicate a greater than forty-five degree tilt to the parking meter has occurred. The plastic cover 72 is sufficiently clear to provide an all angle indicator. An indicia ring 79 may be applied to the plastic cover and, as shown, indicates the level attitude of the switch. In new installations as in FIGS. 1 and 2 in which an auxiliary switch is not needed, plastic cover 67 may be used. This cover is sufficiently clear to provide and employ the indicia 79 as in FIG. 4.

Figure 5:
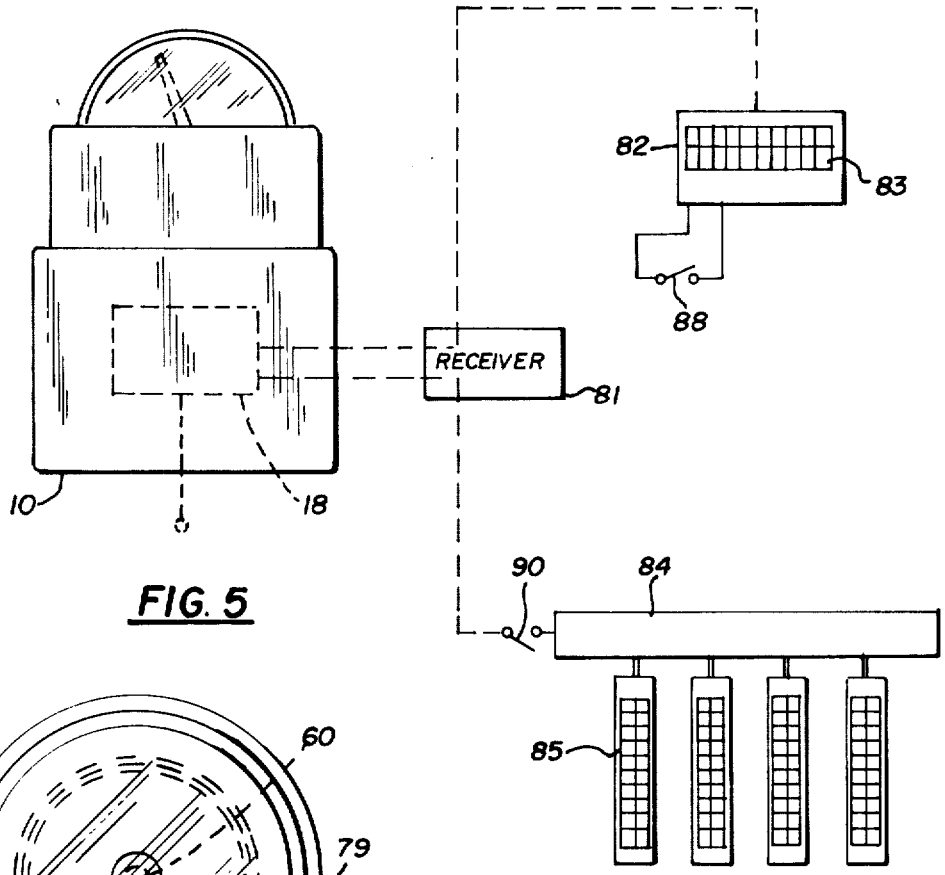
FIG. 5 represents a diagrammatic or schematic view of a transmitter apparatus and a monitor processing station.

Schematic as Shown in FIG. 5

Referring next to FIG. 5 it is to be noted that the transmitter 18 when actuated by a closed switch and timer sends a radio signal whose frequency is coded to correspond to a particular parking meter installation. This signal is sent to a receiver 81 which decodes the signal and sends an indication of a parking meter being vandalized or opened to a monitor indicating device 82, 83, 84 and 85. It is desirable that in addition to the visual alarm an audible alarm be made to indicate to the monitor observer that a certain signal is being transmitted and that a particular parking meter is to be checked out by the police or the meter attendant. It is also to be noted that an additional signal is sent to indicate that the pipe support has been bent. Where and when the pipe has been bent beyond the limit as ascertained by the tilt switch ball 60 a signal is sent to the monitor indicated as 84. A switch 88 or 90 provides the means to shut the indicator lights off or an audible signal if such has been provided.

Figure 6:
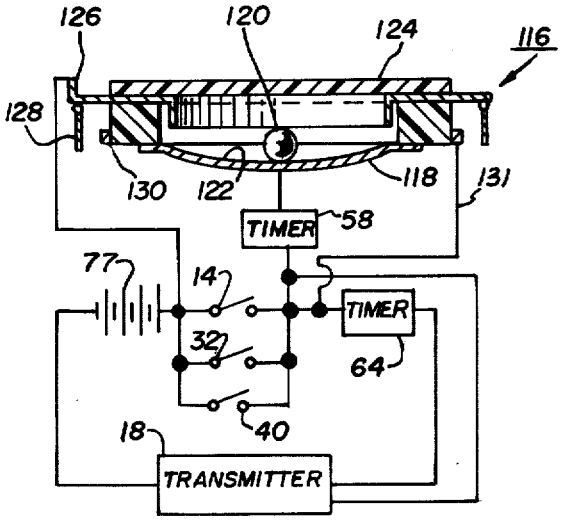
FIG. 6 represents a schematic sectional view of an alternate tilt switch construction.

Alternate Tilt Switch of FIG. 6

In FIG. 6 there is shown an alternate tilt switch construction for determining and reporting a tilt of more than forty-five degrees. Such a tilt indicates excessive vandalism and so this alternate switch construction may be employed. As depicted, switch 116 has a lower conducting plate 118 which not only carries a ball 120 in a shallow depression 122 but has a clear cover 124 which has indicia ring 79 as depicted in FIG. 4. A ring conductor 126 is also provided below this clear cover. An outer ring or conductor 126 carries a plurality of swing members 128. When an excessive tilt occurs, the swing or leaf members swing inwardly to make contact with ring 130. This ring establishes a conducting path to the input side of timer 64.

It is anticipated that the switches, transmitter and other parts in the vandal detecting apparatus within the parking meter housing 10 will be mounted by adhesive. The switches 14 and 32 are preferably of a leaf-type and are actuated by magnetic attraction. Such a switch arrangement prevents tampering with the switch actuation when and while the doors 12 and 30 are partly opened.

The switches and the timers as well as the transmitter 18 are battery powered and to the extent permitted are miniature in size and are at least partially concealed.

Opening of the covers or doors 12 and 30 a small amount sufficient to deactivate or render the switch 14 or 32 inoperative is, of course, not desirable so it is contemplated that these switches will be leaf-type switches closed by the opening of the covers. It is also contemplated that the switch 16, which is an all level switch, will be carried in the mechanism compartment and below the mechanism in such a manner and attitude that a tilt of the mechanism to thirty degrees or more for a period of time such as fifteen seconds will actuate the switch 16 to send a signal to and through the transmitter 18. This timing device delays the actuation of the transmitter signal for that short period of time desirable and necessary so that an accidental bumping of the parking meter as, for example, by a car or the like will not activate a transmitter signal to the monitor.

Where and when the installation is a new parking meter it is desirable and contemplated that a cable or cord 20 will be carried in the pipe 26. This cable or cord is secured by prongs, leaf members 22 (FIG. 1), or the like which members spring or swing outwardly to engage the side wall of the pipe. This cable is then tensioned by means of a spring 36 (FIG. 2) which moves the connected switch 40 into a medium or middle condition. When the pipe 26 is bent or cut the cable is either stretched or becomes shorter and the switch 40 is actuated to immediately cause transmitter 18 to send a radio signal to the monitor that tampering or cutting of the pipe support of the parking meter is occurring and that immediate attention to the vandalism signal should be given.

Where the installation is into an existing parking meter and the pipe is rusted or is otherwise difficult or impossible to remove, signaling apparatus which does not require a cable or cord 20 is utilized. In this case the two conductors from the maximum tilt switch are connected to the transmitter 18. A tilt of more than forty-five degrees indicates that vandalism or a cutting of the pipe is occurring and that immediate attention should be given to this parking meter installation. For this reason the auxiliary tilt switch carried on top of the initial tilt switch is connected directly to the timer and transmitter to indicate when a greater than forty-five degree tilt occurs. This closing of the switch actuates the transmitter to send an immediate signal to the monitor. The monitor, as seen in FIG. 5, is positioned at a reading station whereby parking meters which may number more than one hundred units are indicated by a display on a switch board. Electronic actuation may be in response to a radio signal and by conventional sequencing of the several means readily available. Primarily, it is anticipated that a scanner similar to that used for radio monitoring of distress signals will be provided and as quickly as a signal from a transmitter in a parking meter is transmitted on that particular frequency, it is immediately ascertained and indicated by a light on the monitoring board. That light plus probably an audible signal brings to the attention of the monitor attendant that potential vandalism is occurring at that particular parking meter.

It is also to be noted that the parking meter may be tilted accidently or on purpose and at that time it may be impractical to cause immediate repairs to the pipe support. When this occurs, tilt switch 16, which feeds a signal to a delayed timer, to the transmitter and to the monitor, indicates only that a meter or pipe supporting the meter has been tilted. This signal can then be relayed to the parking meter observer, which may be a police radio patrol, who checks this particular parking meter and reports either by phone or radio to the monitor attendant that the parking meter is in an intact condition but that the support pipe has been bent. When this occurs the monitor observer notes the signal and monitoring can proceed as usual until the next day when a service crew may repair the meter pipe. When the repair is made the pipe is straightened to bring the meter to a substantially level condition. After repairs have been made, a check of the equipment is made to the monitor who then reports that all is o.k. Monitoring for vandalism then proceeds in the usual manner.

It is contemplated that the radio transmitter will be powered by means of a battery, such as the usual nine volt self-container battery, which is secured by plug-in clips. This battery is utilized for the actuation of the transmitter. Such batteries have a long life and can readily be checked as to weakness or run-down condition by means of a battery checking apparatus. Such checking is preferably on a periodic basis and the batteries can be discarded or recharged.

It is to be noted that radio transmitters and receivers are now made in very miniature sizes, such as by chips, so that the radio transmitting apparatus may be very small. The receiving apparatus is mounted a determined distance from the parking meter and is preferably powered by an A/C source. The receiver is left continuously "ON" to receive the signal fed to the monitor. Relay transmission and receiving apparatus may be incorporated. It is contemplated that the parking meters in a certain group will have a grouping of radio receiving and transmitting frequencies which are utilized by one monitoring system. The monitor device may also carry several groupings of parking meters each of which will have their own frequency which may, of course, overlap. The signal and frequency from a particular meter will generally go not more than three or four blocks so that the transmitter for one frequency will not interfere with the frequency used in a similar parking meter in another grouping.

It is to be noted that a parking meter enclosure may be provided with a single access opening with this opening actuated and/or opened by a key. Since such an arrangement is not normally provided this unlikely construction is only mentioned as an alternative provision for a parking meter alarm. Normally the transmitter is contemplated to produce two frequencies. One frequency is preferably alike for all parking meters in a defined group such as one hundred monitored meter installations. The other produced frequency is contemplated to be a transmitted frequency which is peculiar or particular to one parking meter in the group. When this transmitted signal is sent to the parking monitor display it is contemplated that the signal receiving device scans or otherwise receives this signal and displays an identification for one of a group display so that a particular meter is indicated or signaled on the monitor board.

Electronic means may be and is contemplated for receiving only a single frequency and after a determined time period a pulsed signal is sent to indicate a particular vandal condition such as a bent pipe. When such an indication of vandalism occurs the signal frequency is made to indicate a particular parking meter installation.

Terms such as "left", "right", "up", "down", "bottom", "top", "front", "back", "in", "out", and the like are applicable to the embodiments shown and described in conjunction with the drawings. These terms are merely for the purposes of description and do not necessarily apply to the position in which the vandalism alarm may be constructed or used.

While a particular embodiment of the parking meter vandalism alarm has been shown and described it is to be understood the invention is not limited thereto since modifications may be made within the scope of the accompanying claims and protection is sought to the broadest extent the prior art allows.

What is claimed is:

1. A parking meter vandal alarm apparatus which includes a radio transmitter secured therein and adapted to send a radio signal in response to an electrical actuation signal to a radio receiver, said signal indicated on a monitor, said apparatus including: (a) a parking meter of conventional construction including a housing and having at least one access door to be opened and closed by a key or the like; (b) a battery within said parking meter housing; (c) a first switch in association with said access door and disposed in a normally open condition, any slight movement toward the opening of the access door causing the switch to close and produce a first electrical actuation signal produced by said battery; (d) a first timer in association with said first switch and having a timed period of selected duration whereby the closing of said first switch causes the electrical actuation signal to continue for said selected time period beyond the closing and then opening of said first switch; (e) a first tilt switch normally in an "open" condition and contained within the parking meter housing and disposed so as to be actuated to a closed condition and produce a second electrical actuation signal produced by said battery when the housing is displaced to an attitude of about twenty to forty-five degrees; (f) a second timer associated with said first tilt switch, said timer delaying the produced signal from the first tilt switch in the closed actuated condition for a selected period of time, this time delay enabling a jarring, shaking and the like of the meter to occur without producing an electrical actuation; (g) a second tilt switch which is within the housing and support, said second tilt switch in a normally "open" condition and being activated to a closed condition when the housing and/or a support is tilted to more than forty-five degrees producing an electronic signal produced by said battery indicating a tilt of the housing beyond said designated angle, such an angle indicating vandalism which may also include cutting of the support; (h) a conducting means in association with this second tilt switch connected to feed a produced signal to and through said first timer and producing an electrical signal persisting for a determined period of time after actuation; (i) a radio transmitter of a relatively short range powered by said battery and arranged so that when a switch is closed an actuation signal produced by said battery is supplied to the transmitter and at least one frequency signal is broadcast from the transmitter, and (j) a radio receiver at a distance from the transmitter and having a constant "on" power source and having means for monitoring said signals.

2. A parking meter vandal alarm as in claim 1 in which the first tilt switch includes a ball movable in a cup-shaped recess, a closing of said tilt switch producing an electrical actuation signal which actuates the first timer, the output from said first timer being fed to and through the second timer to the transmitter.

3. A parking meter vandal alarm as in claim 2 in which the parking meter housing includes two access doors, one door providing an access to the clock mechanism and the other door providing an access to the coin collection means, each door having a switch in association therewith, each switch being normally open and being moved to a closed condition with a slight opening movement of the associated door, these switches being associated with said first timer so that an electrical actuation signal continues beyond the closing of either of the access doors.

4. A parking meter vandal alarm as in claim 3 in which there is provided an additional switch which is disposed so as to be actuated by the movement of a cable being secured in a support pipe, said cable tensioned by a bias means and this additional switch being actuated to a closed condition by and with a bending and/or cutting of the support pipe, this additional switch being connected to the battery, transmitter and the first timer so as to feed a vandalism indicator signal for a selected duration to the transmitter.

5. A parking meter vandal alarm as in claim 3 in which the additional switch is responsive to a tilt of greater than forty-five degrees and includes a second ball carried in a shallow arcuate recess in a base member and a cover having a mating and matching arcuate configuration and so spaced that said ball is movable in only a determined path between the base and cover, said additional switch including two conducting rings positioned at the termination of the arcuate recess, these rings displaced from each other sufficiently to provide a non-conducting path; the ball, when moved into contact with the rings, engaging both conducting rings and providing a closed switch circuit which actuates a signal to the second timer and transmitter.

6. A parking meter vandal alarm as in claim 3 in which the additional switch is responsive to a tilt of greater than forty-five degrees includes a tilt switch having a plurality of depending and pivotally mounted conducting arms with at least one of these arms swinging inwardly in response to said tilt to engage a conducting ring-like member, said arrangement of pivoted arms and the ring-like member providing a closed switch when an arm engages the ring-like member to activate a signal to the first timer and transmitter.

7. A parking meter vandal alarm as in either claim 5 or 6 in which there is provided in the top cover of the tilt switch an indicia ring which with a rolling ball provides a level indicator whereby the rolling ball when centered in the indicia ring indicates a level condition of the tilt switch.

8. A parking meter vandal alarm as in claim 1 in which the transmitter sends a plurality of frequency signals to the receiver which detects these sent signals and to a visual monitor which indicates both the meter by an appropriate number and also whether a tilt has occurred.

* * * * *